US011040257B2

(12) United States Patent
Nakamura et al.

(10) Patent No.: US 11,040,257 B2
(45) Date of Patent: Jun. 22, 2021

(54) GOLF CLUB

(71) Applicant: SUMITOMO RUBBER INDUSTRIES, LTD., Kobe (JP)

(72) Inventors: Takashi Nakamura, Kobe (JP); Masahiko Ueda, Kobe (JP); Wataru Kimizuka, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/840,645

(22) Filed: Apr. 6, 2020

(65) Prior Publication Data

US 2020/0338400 A1 Oct. 29, 2020

(30) Foreign Application Priority Data

Apr. 26, 2019 (JP) ..... JP2019-085361

(51) Int. Cl.
*A63B 53/14* (2015.01)
*A63B 53/04* (2015.01)
*A63B 60/02* (2015.01)

(52) U.S. Cl.
CPC ..... *A63B 53/047* (2013.01); *A63B 53/0408* (2020.08); *A63B 53/0466* (2013.01); *A63B 53/14* (2013.01); *A63B 60/02* (2015.10)

(58) Field of Classification Search
CPC . A63B 53/0466; A63B 53/0408; A63B 53/14; A63B 60/02; A63B 53/047; A63B 60/14; A63B 60/08; A63B 60/16; A63B 2209/10; A63B 60/24; A63B 60/50; A63B 60/54; A63B 60/42
See application file for complete search history.

(56) References Cited

U.S. PATENT DOCUMENTS

2004/0192462 A1* 9/2004 Ashida ..... A63B 53/10 473/319
2015/0360092 A1* 12/2015 Nakamura ..... A63B 53/0466 473/292
2019/0009155 A1 1/2019 Mizutani et al.

FOREIGN PATENT DOCUMENTS

JP 11285550 A * 10/1999

* cited by examiner

*Primary Examiner* — Stephen L Blau
(74) *Attorney, Agent, or Firm* — Birch, Stewart, Kolasch & Birch, LLP

(57) ABSTRACT

A golf club includes a head; a shaft; and a grip. The head has a weight Wh of greater than or equal to 195 g. The golf club has a club length Lc of greater than or equal to 45.0 inches. The golf club has a club weight Wc of greater than or equal to 295 g. The golf club has a swing moment of inertia Isw of less than or equal to $5470\times10^3$ ($g\cdot cm^2$). The swing moment of inertia Isw ($g\cdot cm^2$) is calculated by the following formula (1):

$$Isw=Wc\times(Lg+40)^2+Ic \quad (1),$$

where Wc represents the club weight (g), Lg represents a distance (cm) in an axial direction between a butt end of the grip and a center of gravity of the golf club, and Ic represents a moment of inertia ($g\cdot cm^2$) of the golf club about the center of gravity of the golf club.

8 Claims, 7 Drawing Sheets

GOLF CLUB

This application claims priority on Patent Application No. 2019-085361 filed in JAPAN on Apr. 26, 2019. The entire contents of this Japanese Patent Application are hereby incorporated by reference.

BACKGROUND OF THE INVENTION

Field of the Invention

The present disclosure relates to a golf club.

Description of the Related Art

Japanese Patent No. 6305611 (US2019/0009155A1) proposes a golf club that is capable of improving the stability of swing.

SUMMARY OF THE INVENTION

The inventors of the present disclosure have obtained new knowledge on influences of a golf club on swing. The present disclosure provides a golf club that is easy to swing and is capable of improving the path of swing.

In one aspect, a golf club includes a head; a shaft; and a grip. The head has a weight Wh of greater than or equal to 195 g. The golf club has a club length Ls of greater than or equal to 45.0 inches. The golf club has a club weight Wc of greater than or equal to 295 g. The golf club has a swing moment of inertia Isw of less than or equal to $5470\times10^3$ ($g\cdot cm^2$), the swing moment of inertia Isw ($g\cdot cm^2$) being calculated by the following formula (1):

$$Isw=Wc\times(Lg+40)^2+Ic \quad (1),$$

where Wc represents the club weight (g), Lg represents a distance (cm) in an axial direction between a butt end of the grip and a center of gravity of the golf club, and Ic represents a moment of inertia ($g\cdot cm^2$) of the golf club about the center of gravity of the golf club.

DESCRIPTION OF THE PREFERRED EMBODIMENTS

Knowledge as Basis of Present Disclosure

The inventors of the present disclosure studied influences of a golf club on swing. As a result, they have found that general amateur golfers are not able to pull their arms down, from the top of swing through the former half stage of downswing in a swinging motion, due to weakness of their core and arms. For this reason, the swing path by amateur golfers tends to go out of a swing plane, which causes the swing path to travel from outside to inside (hereinafter referred to as "outside-in swing path"). This tends to lead variation in hitting points and tends to spin the hit ball so as to cause a slice shot. The present disclosure is based on this new knowledge, and relates to a golf club that is easy to swing and is capable of improving the path of swing.

It should be noted that the term "axial direction" used in the present application means the axial direction of the shaft.

Figure 1:
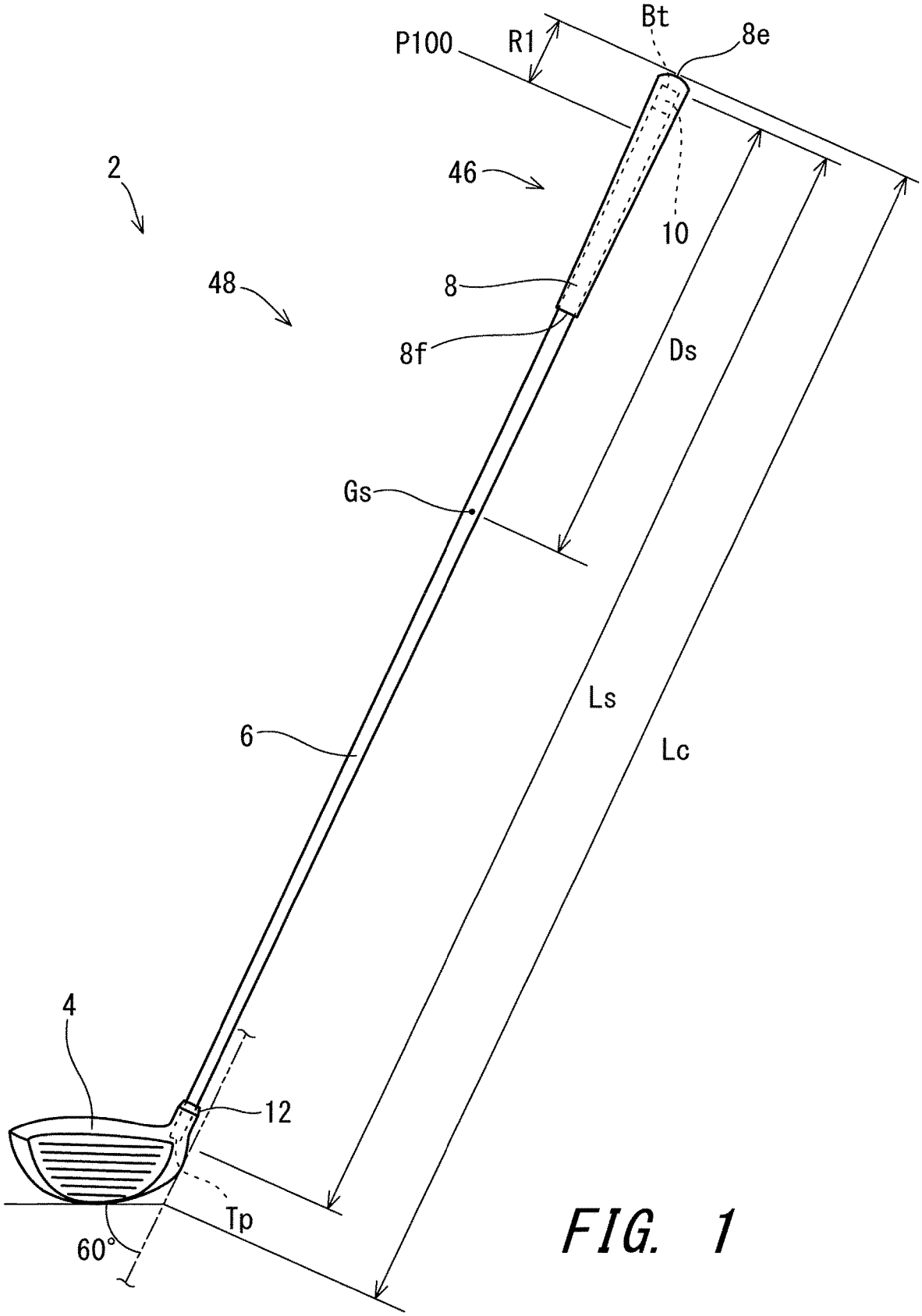
FIG. 1 shows a golf club according to one embodiment.

FIG. 1 shows an overall view of a golf club 2, which shows an embodiment of the present disclosure. As shown in FIG. 1, the golf club 2 includes a golf club head 4, a shaft 6, a grip 8, and a weight member 10. The weight member 10 is located inside the grip 8. Further, the golf club 2 includes a ferrule 12.

In the present embodiment, the golf club 2 is a driver (No. 1 wood). Typically, the club as a driver has a length of greater than or equal to 43 inches. The golf club 2 is preferably a wood-type golf club, and more preferably a driver. The golf club number of the golf club 2 is not limited.

A bidirectional arrow Lc in FIG. 1 indicates a length of the golf club 2. The method for measuring the club length Lc is described below.

The golf club 2 includes a butt end region R1. The butt end region R1 is defined as a region having a distance from a butt end 8*e* of the grip 8 of less than or equal to 100 mm. In other words, the butt end region R1 is a region that extends from a point P100 that is 100 mm away from the butt end 8*e* of the grip 8 in the axial direction, to the butt end 8*e* of the grip 8.

In the present embodiment, the head 4 has a hollow structure. The head 4 is of a wood type. The head 4 may be of a hybrid type. The head 4 may be of an iron type. Examples of the material for the head 4 include metals and fiber reinforced plastics. Examples of the metals include titanium alloys, pure titanium, stainless steel, and soft iron. Examples of the fiber reinforced plastics include carbon fiber reinforced plastics. The head may be a composite head that has a metal part and a fiber reinforced plastic part.

The head 4 is attached to an end on a tip end Tp side of the shaft 6. The grip 8 is attached to an end on a butt end Bt side of the shaft 6. The head 4 has a head weight Wh.

The shaft 6 is formed with a laminate of fiber reinforced resin layers. The shaft 6 is in a tubular form. The shaft 6 has a hollow structure. As shown in FIG. 1, the shaft 6 includes the tip end Tp and the butt end Bt. The tip end Tp is positioned inside the head 4. The butt end Bt is positioned inside the grip 8.

The shaft 6 has a shaft weight Ws. The shaft 6 has a center of gravity Gs. The shaft center of gravity Gs is a center of gravity of the shaft 6 when isolated as a single member. The center of gravity Gs is positioned on the axis line of the shaft.

A bidirectional arrow Ls in FIG. 1 indicates a length of the shaft. The shaft length Ls is a distance in the axial direction from the tip end Tp to the butt end Bt. A bidirectional arrow Ds in FIG. 1 indicates a distance in the axial direction from the butt end Bt to the shaft center of gravity Gs.

The material of the shaft 6 is preferably a fiber reinforced resin. With a view to reducing the weight, a carbon fiber reinforced resin is preferable as the material of the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire.

The prepreg sheet contains fibers and a resin. This resin is also referred to as a matrix resin. Typically, the fibers are carbon fibers. Typically, the matrix resin is a thermosetting resin.

The shaft 6 is produced by a so-called sheet winding method. In the prepreg, the matrix resin is in a semi-cured state. The shaft 6 is formed by winding and curing a prepreg sheet. The shaft 6 may be produced by a so-called filament winding method.

As the matrix resin of the prepreg sheet, an epoxy resin, a thermosetting resin other than an epoxy resin, or a thermoplastic resin, etc. may be used. From the viewpoint of shaft strength, a preferable matrix resin is an epoxy resin.

The method for producing the shaft 6 is not limited. From the viewpoint of design freedom, a shaft produced by the sheet winding method is preferred. Note that the material for the shaft 6 is not limited. The shaft 6 may be, for example, a steel shaft.

The grip 8 is a part that a golfer grips in a swinging motion. The grip 8 has a grip weight Wg.

Examples of the material of the grip 8 include rubber compositions and resin compositions. Examples of rubber contained in the rubber composition include natural rubber (NR), ethylene propylene diene monomer rubber (EPDM), styrene butadiene rubber (SBR), isoprene rubber (IR), butadiene rubber (BR), chloroprene rubber (CR), and acrylonitrile butadiene rubber (NBR). In particular, natural rubber, or natural rubber blended with a rubber having excellent affinity for natural rubber, such as ethylene propylene diene rubber or styrene butadiene rubber, is preferable. Examples of resin contained in the resin composition include a thermoplastic resin. The thermoplastic resin can be used in injection forming. This thermoplastic resin is preferably a thermoplastic elastomer, and more preferably a thermoplastic elastomer containing a soft segment and a hard segment. With a view to achieving both of the desired grip property and the abrasion resistance, urethane-based thermoplastic elastomer is further preferable. From the viewpoint of formability, EPDM and styrene butadiene rubber are more preferable.

The rubber composition for the grip 8 may be a foam rubber. A foam rubber contains many air bubbles, thereby having a low specific gravity. A foaming agent may be mixed in the foam rubber. One example of this foaming agent is a thermally decomposable foaming agent. Examples of this thermally decomposable foaming agent include azo compounds such as azodicarbonamide, nitroso compounds such as dinitrosopentamethylene tetramine, and triazole compounds. The foam rubber contributes to the lightweighting of the grip 8.

A plurality of types of rubbers having different expansion ratios may be used. Examples of the rubbers having different expansion ratios may include a non-foam rubber (having an expansion ratio of zero). By adjusting the arrangement of the plurality of types of rubbers, the position of the center of gravity of the grip 8 can be adjusted.

The method for producing the grip 8 is not limited. The grip 8 can be produced by a known producing method. Examples of the producing method include press-forming and injection forming.

When a plurality of types of rubbers having different expansion ratios are used, press-forming is preferred. In this case, for example, a rubber sheet 1 made of a material formed at a first expansion ratio, and a rubber sheet 2 made of a material formed at a second expansion ratio, are prepared. These sheets are placed at arbitrary positions in a mold, respectively, and are heated and pressurized, whereby press-forming is performed. In this method, rubbers having different expansion ratios can be arranged independently and freely.

The golf club 2 includes the weight member 10. The weight member 10 does not have to be present. For example, the center of gravity of the grip 8 is positioned closer to the butt end by adjusting weight distribution of the grip 8 without using the weight member 10. Preferably, the weight member 10 is used.

The weight member 10 is located inside the grip 8. The weight member 10 is attached to the shaft 6. The weight member 10 is attached in the vicinity of the butt end Bt of the shaft 6. The weight member 10 is attached in the butt end region R1 described above. An entirety of the weight member 10 is positioned in the butt end region R1. The center line of the weight member 10 coincides with the center line Z1 of the shaft 6.

The weight member 10 may be attached to the shaft 6, or alternatively, may be attached to the grip 8. The weight member 10 in the present embodiment is not exposed to outside. At least a part of the weight member 10 may be exposed to outside.

Figure 2:
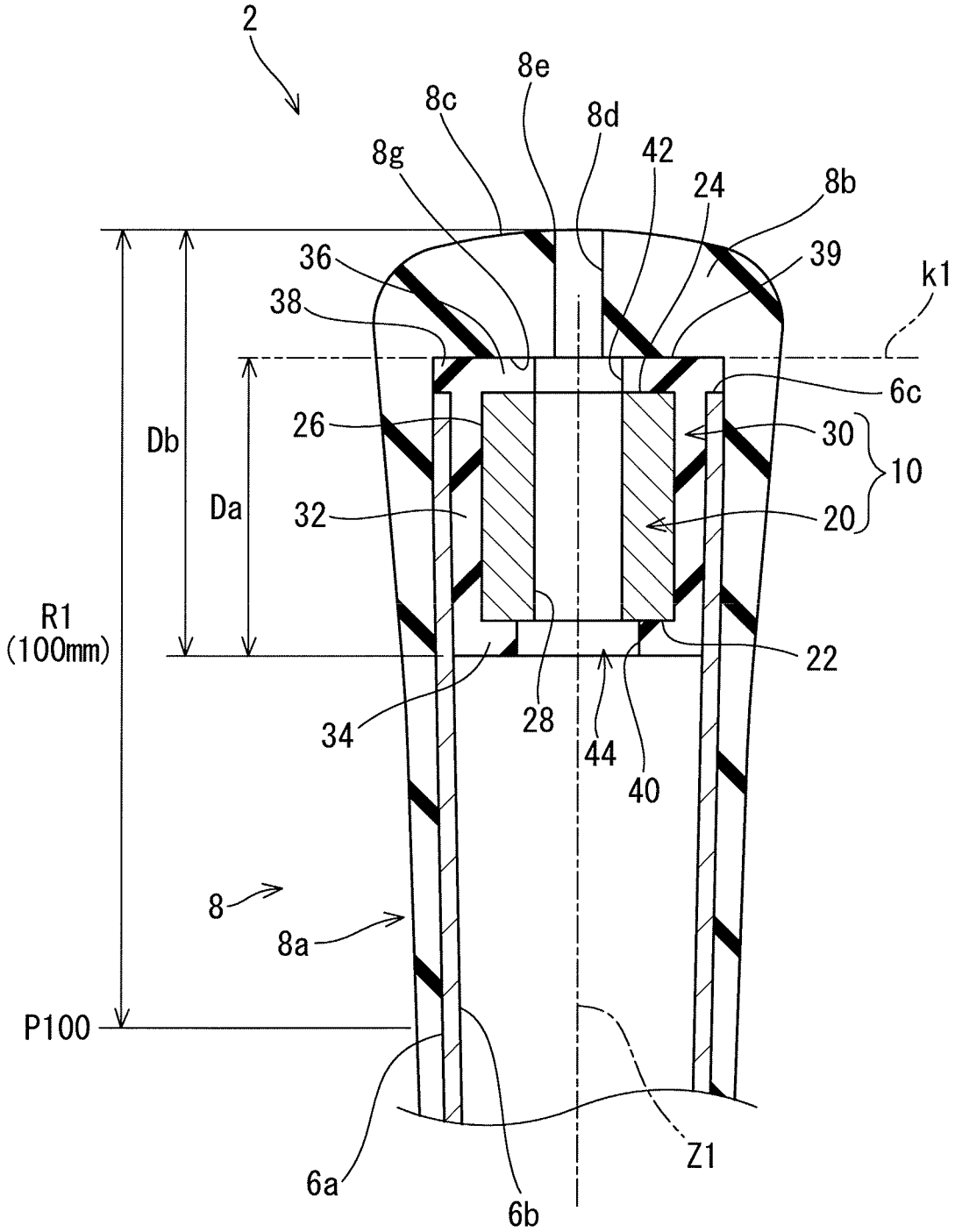
FIG. 2 is a cross-sectional view of the golf club shown in FIG. 1, taken in the vicinity of a grip butt end.

FIG. 2 is a cross-sectional view of the golf club 2, taken in the vicinity of the butt end Bt of the shaft 6.

The shaft 6 is a pipe having a hollow inside. When viewed in a cross section taken along a plane perpendicular to the center line of the shaft 6, an outer surface 6*a* of the shaft 6 is circular. When viewed in the cross section taken along a plane perpendicular to the center line of the shaft 6, an inner surface 6*b* of the shaft 6 is circular. The shaft 6 includes a butt end face 6*c*. The butt end face 6*c* is an end face of the shaft 6 at the butt end Bt. The butt end face 6*c* is an annular surface.

The grip 8 is attached on the butt end Bt side of the shaft 6. The grip 8 includes a grip body portion 8*a* and an end cap portion 8*b*. The end cap portion 8*b* closes an opening on the butt end side of the grip body portion 8*a*. The end cap portion 8*b* forms a butt end face 8*c* of the grip 8. The grip body portion 8*a* is a tube. The grip body portion 8*a* includes a taper portion that tapers off as the proximity to the end face 8*c* decreases. On the tip end side of the grip body portion 8*a*, an opening (not shown) that allows the shaft 6 to be inserted therethrough is formed. The end cap portion 8*b* includes a through hole 8*d*. The through hole 8*d* has a function of releasing air when the shaft 6 is inserted into the grip 8.

The two-dot chain line in FIG. 2 indicates a boundary k1 between the grip body portion 8*a* and the end cap portion 8*b*. For example, at the position of this boundary k1, the grip body portion 8*a* and the end cap portion 8*b* are separated. The end cap portion 8*b* is positioned on the butt end 8*e* side with respect to the grip body portion 8*a*. In the present embodiment, the end cap portion 8*b* is formed with a non-foam rubber exclusively. On the other hand, the grip body portion 8*a* includes a foam rubber portion made of a foam rubber. This foam rubber portion contains many air bubbles, thereby having a low specific gravity. The end cap portion 8*b* has a specific gravity greater than the specific gravity (average specific gravity) of the grip body portion 8*a*. This configuration makes a contribution in allowing the center of gravity of the grip 8 to be set closer to the butt end 8*e*.

Figure 3:
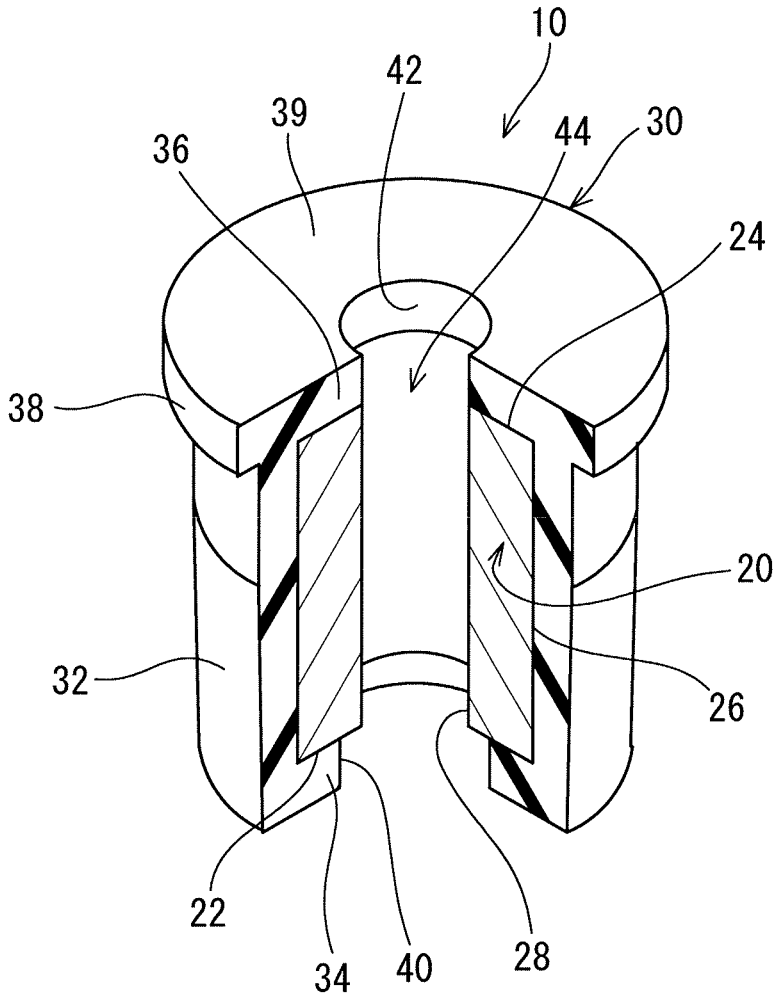
FIG. 3 is a partially cut-away perspective view of a weight member.

FIG. 3 is a perspective view of the weight member 10.

The weight member 10 includes a weight body 20 and a cover member 30. The weight body 20 is made of a metal. The cover member 30 is made of a rubbery elastomer. The weight body 20 can be formed by casting, forging, sintering, die casting, press forming, or the like. The cover member 30 can be formed by injection forming, or the like. With use of a mold in which a formed weight body 20 is set, the cover member 30 can be formed by injection forming. Alternatively, the weight body 20 and the cover member 30, which are formed separately, can be joined to each other.

The metal material for the weight body 20 is not limited particularly. With a view to concentrating weight in the butt end region R1, the weight body 20 preferably has a specific gravity of greater than or equal to 5.0, more preferably greater than or equal to 7.0, and further preferably greater than or equal to 8.0. From the viewpoint of the cost and the formability, the weight body 20 preferably has a specific gravity of less than or equal to 20, more preferably less than or equal to 18, and further preferably less than or equal to 15. In the present embodiment, brass is used for forming the weight body 20. An alloy containing tungsten and nickel can also be used favorably.

With a view to concentrating weight in the butt end region R1, the weight of the weight member 10 is preferably greater than or equal to 2 g, more preferably greater than or equal to 4 g, and further preferably greater than or equal to 6 g. With a view to preventing the club weight We from becoming excessively great, the weight of the weight member 10 is preferably less than or equal to 20 g, more preferably less than or equal to 15 g, and further preferably less than or equal to 10 g.

The weight body 20 includes a first end face 22, a second end face 24, and an outer circumferential surface 26. The first end face 22 is positioned on the tip end Tp side, and the second end face 24 is positioned on the butt end Bt side, in the shaft axial direction. In the present embodiment, the first end face 22 and the second end face 24 are formed by planes perpendicular to the shaft axial direction; however, these are not limited to such configurations.

The outer circumferential surface 26 of the weight body 20 is a cylindrical surface. The center line of the outer circumferential surface 26 coincides with the center line Z1 of the shaft 6. A through hole 28 extending in the shaft axial direction is formed in the weight body 20. Therefore, the weight body 20 in the present embodiment is formed in a cylindrical shape.

The cover member 30 covers the weight body 20. The cover member 30 is made of a rubbery elastomer. The rubbery elastomer is a material having a rubbery elasticity, and examples of the same include a vulcanized rubber, as well as resin-based materials. The cover member 30 in the present embodiment is made of a vulcanized rubber.

The cover member 30 includes a side cover 32, a first end cover 34, a second end cover 36, and a flange portion 38. The side cover 32 covers the outer circumferential surface 26 of the weight body 20. The side cover 32 covers an entirety of the outer circumferential surface 26 of the weight body 20. The side cover 32 is configured to cover an entirety in the circumferential direction and in the shaft axial direction of the outer circumferential surface 26 of the weight body 20. The side cover 32 is in a cylindrical shape.

The first end cover 34 is continuous with the side cover 32. The first end cover 34 covers the first end face 22 of the weight body 20. The first end cover 34 covers a part of the first end face 22 of the weight body 20. Furthermore, a first through hole 40 that is continuous with the center through hole 28 in the weight body 20 is formed in the first end cover 34. The center line of the first through hole 40 coincides with the center line of the center through hole 28.

The second end cover 36 is continuous with the side cover 32. The second end cover 36 covers the second end face 24 of the weight body 20. The second end cover 36 covers an entirety of the second end face 24 of the weight body 20. Furthermore, a second through hole 42 that is continuous with the center through hole 28 in the weight body 20 is formed in the second end cover 36. The center line of the second through hole 42 coincides with the center line of the center through hole 28.

A weight through hole 44 that penetrates through the weight member 10 is composed of the through hole 28 of the weight body 20, the first through hole 40, and the second through hole 42. As shown in FIG. 2, the weight through hole 44 is continuous with the through hole 8*d* formed in the end cap portion 8*b*.

The flange portion 38 is continuous with the second end cover 36. The flange portion 38 protrudes from the second end cover 36 toward outside in the shaft radial direction. The flange portion 38 protrudes toward outside in the radial direction with respect to the side cover 32. The flange portion 38 abuts on the butt end face 6*c*. The flange portion 38 covers the butt end face 6*c* of the shaft 6. The flange portion 38 covers an entirety of the butt end face 6*c*. The flange portion 38 is a continuous annular portion that is continuous in the shaft circumferential direction.

The center line of the weight member 10 coincides with the center line Z1 of the shaft 6, but it is not limited to such a configuration. The weight member 10 does not have to have a center line. From the viewpoint of the uniformity of the weight distribution in the shaft circumferential direction, the center line of the weight member 10 preferably coincides with the center line Z1 of the shaft 6.

In the weight member 10, the outer diameter of the side cover 32 is set so that the weight member 10 can be located inside the shaft 6. The outer diameter of the flange portion 38 is greater than the inner diameter of the butt end face 6*c*. The flange portion 38 abuts on the butt end face 6*c*. The flange portion 38 is engaged with the butt end face 6*c*. With this engagement, the positioning of the weight member 10 is achieved. In addition, this engagement allows the weight member 10 to be prevented from dropping to the inside of the shaft 6. As shown in FIG. 2, the flange portion 38 is interposed between the butt end face 6*c* and the end cap portion 8*b*. The flange portion 38 makes a contribution in surely fixing the weight member 10.

The weight member 10 may be fixed to the shaft 6, or alternatively, may be fixed to the grip 8, or further alternatively, may be fixed to between the shaft 6 and the grip 8. In the present embodiment, the weight member 10 is fixed to the shaft 6. Further, in the flange portion 38, the weight member 10 is interposed between the shaft 6 and the grip 8. Furthermore, an end face 39 of the weight member 10 on the grip butt end 8*e* side is in surface contact with the inner face 8*g* of the end cap portion 8*b*. These configurations make a contribution in surely fixing the weight member 10. In a case where the weight member 10 is fixed to the grip 8, for example, the weight member 10 may be embedded in the end cap portion 8*b* of the grip 8. As another example in the same case, a weight attachment part for the attachment of the weight member 10 may be provided on the butt end face 8*c* of the grip 8, and the weight member 10 may be attached to this weight attachment part.

A method for attaching the weight member 10 to the golf club 2 is as follows. First, the shaft 6 to which the grip 8 has not been attached is prepared. To the shaft 6, the golf club head 4 may be attached preliminarily. Next, on the butt end Bt side of the shaft 6, the weight member 10 is inserted. This insertion allows the side cover 32 of the weight member 10 to be located inside the shaft 6. At the same time, the flange portion 38 is engaged on the butt end face 6*c* of the shaft 6. Next, the shaft 6 incorporating the weight member 10 is inserted into the grip 8. Through these steps, the weight member 10 is attached to the golf club 2. The grip 8 is bonded to the outer surface 6*a* of the shaft 6, for example, with a double-sided adhesive tape.

The weight member 10 is surely fixed in the butt end region R1. Furthermore, of the weight member 10, contact surfaces with the shaft 6 are formed by the cover member 30, which suppresses the occurrence of strange sound. The weight member 10 which includes the cover member 30 and the weight body 20 located inside the cover member 30 absorbs vibration of the shaft 6, thereby improving feel at impact of the golf club 2.

A bidirectional arrow Da in FIG. 2 indicates a length of the weight member 10 in the axial direction. With a view to concentrating weight on the butt end Bt side, the length Da is preferably less than or equal to 50 mm, more preferably less than or equal to 45 mm, and further preferably less than or equal to 40 mm. With a view to increasing the weight of the weight member 10, the length Da is preferably greater than or equal to 5 mm, more preferably greater than or equal to 10 mm, and further preferably greater than or equal to 15 mm.

A bidirectional arrow Db in FIG. 2 indicates a distance between the tip end Tp side end of the weight member 10 and the butt end 8*e* of the grip 8. The distance Db is measured along the axial direction. With a view to concentrating weight on the butt end Bt side, the distance Db is preferably less than or equal to 70 mm, more preferably less than or equal to 60 mm, further preferably less than or equal to 50 mm, and still further preferably less than or equal to 40 mm. With a view to increasing the weight of the weight member 10, the distance Db is preferably greater than or equal to 15 mm, more preferably greater than or equal to 20 mm, and further preferably greater than or equal to 25 mm.

The cover member 30 in the present embodiment may have a JIS-A hardness of, preferably, greater than or equal to 50 degrees and less than or equal to 70 degrees. The hardness being set in the above-described range allows the flange portion 38 and the like to maintain a sufficient strength, while enhancing the vibration absorption effect achieved by the cover member 30, whereby the feel at impact of the golf club 2 can be improved. Note that the JIS-A hardness is measured by a Type A durometer under a temperature environment of 23° C. according to JIS-K6253.

1. Relationship Between Specifications of Golf Club and Swing

The inventors of the present disclosure closely studied swing, based on new viewpoints. As a result, they have found that the specifications of a golf club could adversely affect swing. A conventional heavy golf club cannot increase the head speed, resulting in a short flight distance. From this viewpoint, a lightweight golf club whose parts other than the head have a reduced weight has been developed. This lightweight golf club contributes to increased head speed. The inventors of the present disclosure, however, have found that this conventional lightweight golf club could adversely affect swing.

1-1. Deviation in Swing Path Resulting from Specifications of Golf Club

Figure 4:
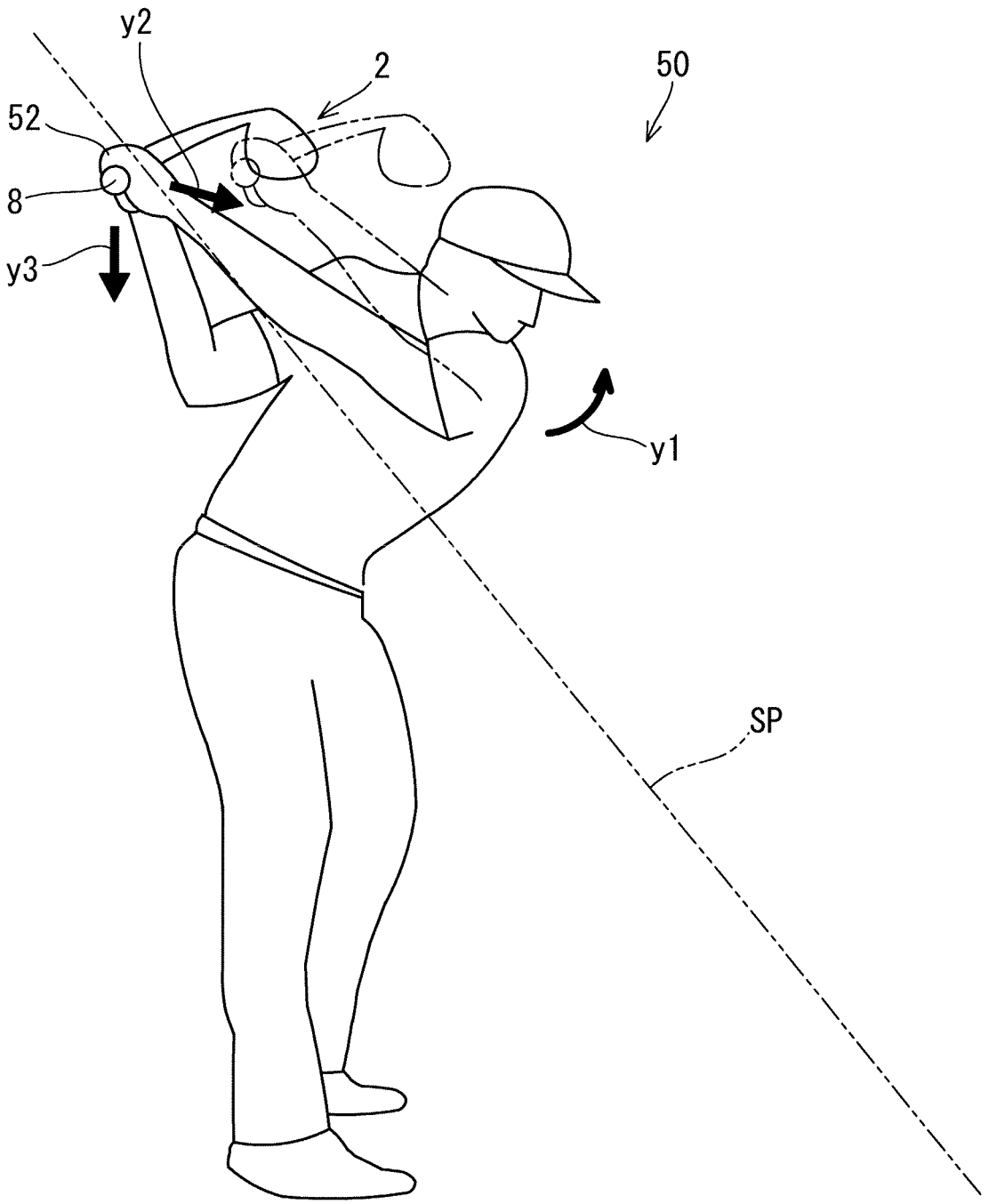
FIG. 4 shows a state of a golfer in a swinging motion, at the top of swing, viewed from the rear side in the target direction.

FIG. 4 shows a state of a golfer 50 in a swinging motion, viewed from the rear side in the target direction. FIG. 4 shows a phase at the top-of-swing (top). The golfer 50 in a swinging motion holds the grip 8 of the golf club 2 with hands 52. The hands 52 include the right hand and the left hand. The hands 52 mean the finger-side portions with respect to the wrists.

In FIG. 4, a swing plane SP is indicated with a two-dot chain line. Ideal swing planes SP can be found for respective golfers 50. It is known that a swing in which the golf club 2 and the hands 52 move on the swing plane SP reduces variation in hitting points and stabilizes the path of swing, which is likely to lead to a good shot. This excellent swing is also referred to as an "on-plane swing".

The inventors of the present disclosure studied influences of a golf club on swing. As a result, they have found that general amateur golfers are not able to pull their arms down, from the top through the former half stage of downswing in a swinging motion, due to weakness of their core and arms. For this reason, from the top through the former half stage of downswing in the swinging motion by the amateur golfers, the golfer's body is firstly rotated (rotation about the golfer's backbone) (see the arrow y1 in FIG. 4). When the golfer's body is firstly rotated (rotation about the golfer's backbone) from the top through the former half stage of downswing in a swinging motion, the arms are delayed and the hands 52 go out of the swing plane SP (the arrow y2 in FIG. 4) (hereinafter referred to as "off-plane swing"). Such an off-plane swing causes a greater variation in swing. This leads to a greater variation in hitting points, thereby also causing variations in flight distance and in directivity of hit balls. The off-plane swing also causes the outside-in swing path, which tends to spin the hit ball so as to cause a slice shot.

Thus, the swing path by amateur golfers tends to go out of the swing plane SP, thereby being likely to lead to the outside-in swing path. This phenomenon has been clarified by accurately measuring the motions of golfers and golf clubs in many swing actions.

It was considered that a heavy club is difficult to swing and decrease the head speed. For this reason, a lightweight club has been developed. As described above, however, it has been found that such a conventional lightweight club tends to cause the off-plane swing.

1-2. Arm Speed Increase Effect

It was considered that the ease-of-swing and the increase of the head speed necessarily require reducing the weight of the club. However, it has been found that an increase in the club weight improves the path of swing. From the top through the former half stage of downswing in a swinging motion, a greater force of gravity acts on the golf club 2, whereby the force works to move the golf club 2 downward (the arrow y3 in FIG. 4). For this reason, the hands 52 easily pass closer to the golfer's body. In a swing in which the hands 52 pass closer to the golfer's body, the golfer is easy to tighten his/her arms, thereby increasing the speed of pulling the arms down. The increased speed of pulling the arms down in the former half stage of downswing increases the kinetic energy of the arms. The kinetic energy of the arms is transmitted to the head 4 of the golf club 2 in the latter half stage of downswing, thereby increasing the head speed (arm speed increase effect).

1-3. On-Plane Effect

As described above, an increase in the club weight enables the golfer to easily pull the arms down from the top through the former half stage of the downswing, whereby the hands 52 are prevented from going out of the swing plane SP. For this reason, it becomes easy to perform a swing on the swing plane SP. In other words, it becomes easy to carry out an on-plane swing. The on-plane swing suppresses the variation in hitting points as well as variation in flight distance and in directivity of hit balls (on-plane effect).

1-4. Swing Correction Effect

As described above, an increase in the club weight attains the arm speed increase effect and the on-plane effect. These advantageous effects are collectively referred to as "swing correction effect".

1-5. Swing MI Reduction Effect

In conventional clubs, an increased weight makes the club difficult to swing, thereby reducing the head speed. However, a decrease in a swing moment of inertia (also referred to as "swing MI") described later makes the club easy to swing even when the club has a heavy weight. By decreasing the swing MI, the club weight Wc is increased while maintaining ease-of-swing, thereby attaining the swing correction effect. Therefore, variation in hitting points can be improved, while flight distance is maintained.

2. Specifications of Golf Club Capable of Enhancing Swing Correction Effect

As described above, the golf club 2 attains the above-described advantageous effects. Specifications of the golf club 2 are detailed as follows.

2-1. Club Weight Wc

From the viewpoint of the swing correction effect, the club weight Wc is preferably greater than or equal to 295 g, and more preferably greater than or equal to 296 g. An excessively great club weight Wc makes amateur golfers difficult to swing the club. From this viewpoint, the club weight Wc is preferably less than or equal to 310 g, more preferably less than or equal to 305 g, and further preferably less than or equal to 300 g.

It has been found that, for amateur golfers having average physical strength (hereinafter, also referred to as "golfers in Category X"), ease-of-swing is not impaired even with a club having a weight of 295 g or greater, by suppressing the swing MI. The golfers in Category X are golfers who swing a driver at a head speed of 40 m/s to 48 m/s and have a handicap of greater than or equal to 15 and less than or equal to 36.

2-2. Swing Moment of Inertia Isw (Swing MI

The swing moment of inertia means a moment of inertia of the golf club 2 about a swing axis. The swing moment of inertia Isw is calculated by the following formula (1). The formula (1) is based on the parallel axis theorem.

$$Isw=Wc\times(Lg+40)^2+Ic \quad (1)$$

where Wc represents the club weight (g), Lg represents a distance (cm) in the axial direction between the butt end 8*e* of the grip 8 and the center of gravity of the club, and Ic represents a moment of inertia ($g\cdot cm^2$) about the center of gravity of the club. The unit of the swing moment of inertia Isw is ($g\cdot cm^2$).

In an actual swinging motion, the golf club rotates together with the golfer's arms about the golfer's body as the rotation axis. In the calculation of the swing moment of inertia Isw, a swing axis Zx is set while taking the position of the golfer's body into consideration. The swing axis Zx is away from the butt end 8*e* of the grip 8. Considering an actual swinging motion, an interval distance Dx between the swing axis Zx and the butt end 8*e* of the grip 8 is set to 40 cm (see FIG. 5). The swing moment of inertia Isw is an index in which actual conditions of swing are reflected.

Figure 5:
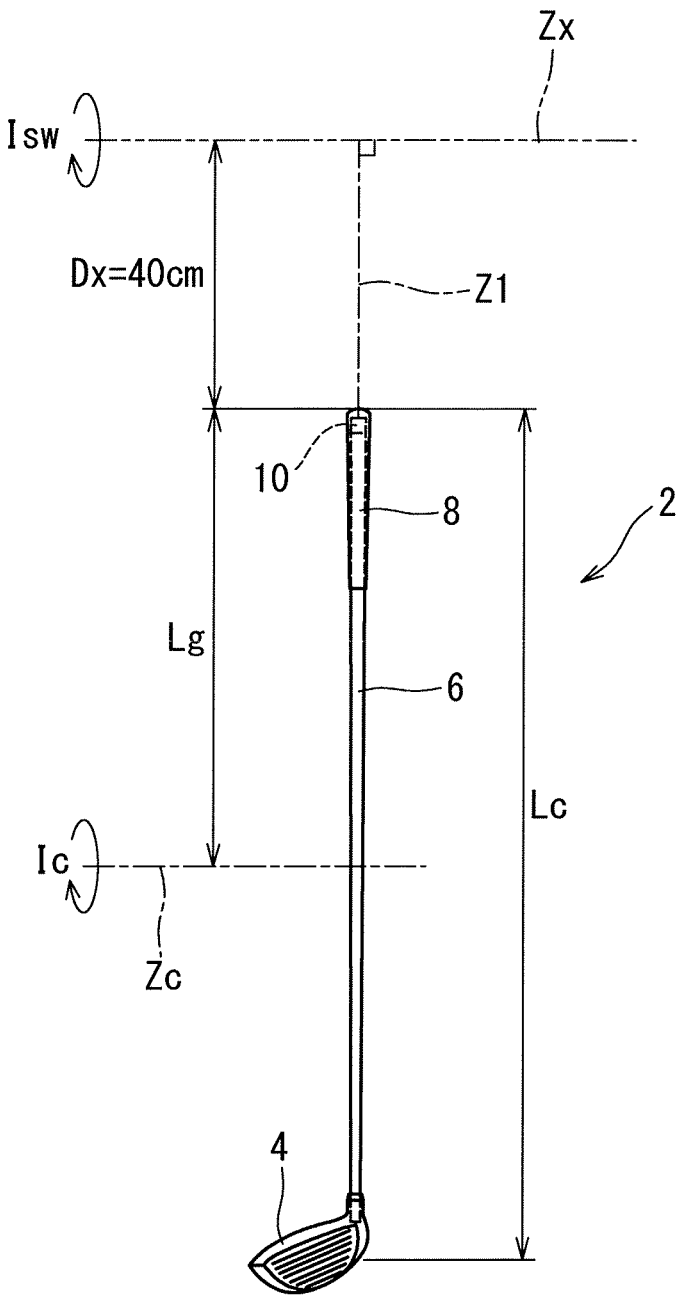
FIG. 5 is a conceptual diagram for explaining a swing moment of inertia.

An axis Zc shown in FIG. 5 is a straight line that passes through the center of gravity of the club. This axis Zc is parallel to the swing axis Zx. The moment of inertia Ic is a moment of inertia of the club 2 about the axis Zc. The swing axis Zx is perpendicular to the shaft axis line Z1. The axis Zc is perpendicular to the shaft axis line Z1.

Figure 6:
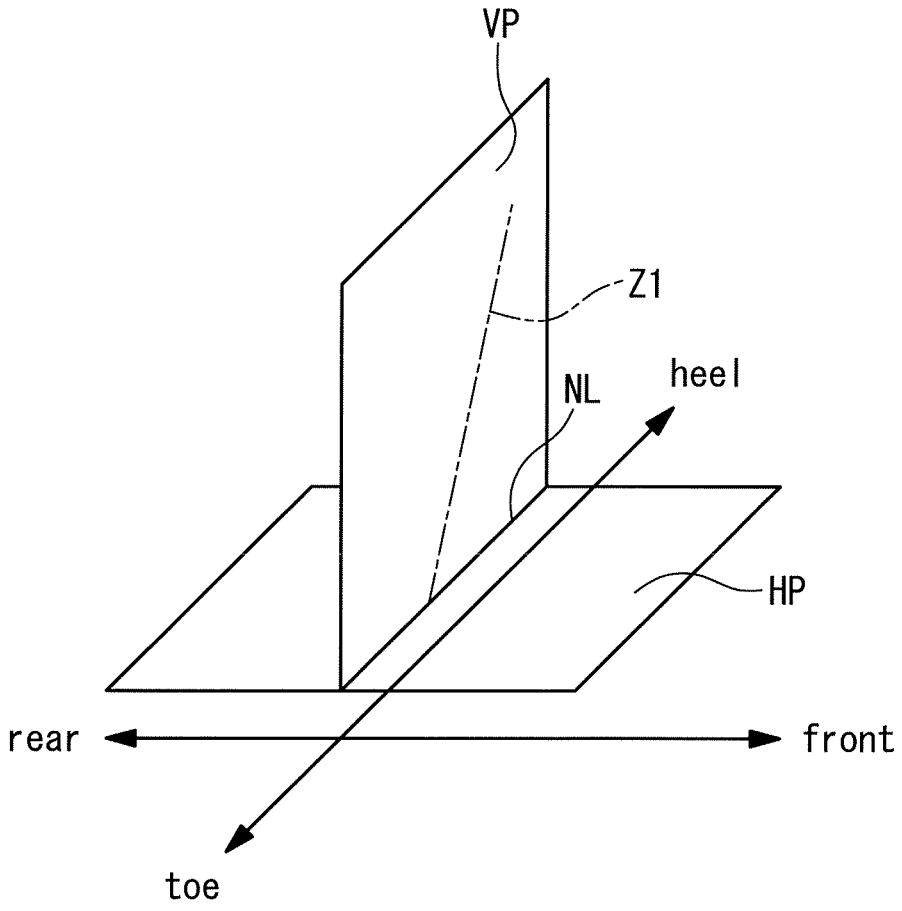
FIG. 6 is a conceptual diagram for explaining a reference state.

In the present application, a "reference state" is defined. The reference state is a state where a sole of the club 2 is placed at a specified lie angle and real loft angle on a horizontal plane. As shown in FIG. 6, in the reference state, the shaft axis line Z1 (shaft center line Z1) is included in a plane VP that is perpendicular to the horizontal plane. The plane VP is defined as a reference perpendicular plane. The specified lie angle and real loft angle are described in, for example, a product catalog.

As is clear from FIG. 5, the moment of inertia Ic is measured in a state where the face surface is made substantially square with respect to the head path. This orientation of the face is an ideal state at impact. The moment of inertia Ic is measured in a state where the axis Zc is included in the reference perpendicular plane VP. Therefore, in the calculated swing moment of inertia Isw, the swing axis Zx is included in the reference perpendicular plane VP. The swing moment of inertia Isw is calculated while taking the posture of the club in the vicinity of the impact into consideration.

With a view to maintaining ease-of-swing even with a heavy club weight Wc, the moment of inertia Isw is preferably less than or equal to $5470\times10^3$ ($g\cdot cm^2$), more preferably less than or equal to $5460\times10^3$ ($g\cdot cm^2$), and further preferably less than or equal to $5450\times10^3$ ($g\cdot cm^2$). Considering the head weight Wh, the moment of inertia Isw is preferably greater than or equal to $5200\times10^3$ ($g\cdot cm^2$), more preferably greater than or equal to $5250\times10^3$ ($g\cdot cm^2$), and further preferably greater than or equal to $5300\times10^3$ ($g\cdot cm^2$).

2-3. Club Length Lc

With a view to increasing the radius of the path of the head 4 so as to increase the head speed, the club length Lc is preferably greater than or equal to 45.0 inches, more preferably greater than or equal to 45.25 inches, and further preferably greater than or equal to 45.50 inches. With a view to suppressing the swing moment of inertia Isw, the club length Lc is preferably less than or equal to 47 inches, more preferably less than or equal to 46 inches, and further preferably less than or equal to 45.75 inches.

2-4. Head Weight Wh

With a view to increasing the kinetic energy of the head 4 and increasing the initial velocity of a ball, the head weight Wh is preferably greater than or equal to 195 g, and more preferably greater than or equal to 196 g. With a view to suppressing the swing moment of inertia Isw, the head weight Wh is preferably less than or equal to 210 g, more preferably less than or equal to 205 g, and further preferably less than or equal to 202 g.

2-5. Grip-End Weight Proportion

The butt end region R1 has a weight that is denoted by W1. A ratio of the weight W1 to the club weight Wc is also referred to as a grip-end weight proportion. The grip-end weight proportion (%) is calculated by (W1/Wc)×100. With a view to increasing the club weight Wc while suppressing the swing moment of inertia Isw, weight is preferably concentrated in the butt end region R1. From this viewpoint, the grip-end weight proportion is preferably greater than or equal to 10.0%, more preferably greater than or equal to 11.0%, and further preferably greater than or equal to 12.0%. Considering weight to be distributed as the head weight Wh, the grip-end weight proportion is preferably less than or equal to 15.0%, more preferably less than or equal to 14.0%, and further preferably less than or equal to 13.0%.

As described above, the butt end region R1 is a region having a distance from the butt end of the golf club 2 in the axial direction of less than or equal to 100 mm. The weight W1 of the butt end region R1 is a weight of the golf club 2 in the butt end region R1. The weight W1 includes the weight of the grip 8 in the region R1, the weight of the weight member 10 in the region R1, and the weight of the shaft 6 in the region R1. Further, when an adhesive, a double-sided adhesive tape, and/or the like is present in the butt end region R1, the weight of those is also included in the weight W1.

2-6. Weight W1 in Butt End Region R1

With a view to increasing the club weight Wc while suppressing the swing moment of inertia Isw, weight is preferably concentrated in the butt end region R1. From this viewpoint, the weight W1 of the butt end region R1 is preferably greater than or equal to 25 g, more preferably greater than or equal to 30 g, and further preferably greater than or equal to 33 g. With a view to preventing the club weight Wc from becoming excessively great, the weight W1 of the butt end region R1 is preferably less than or equal to 60 g, more preferably less than or equal to 50 g, and further preferably less than or equal to 45 g.

2-7. Moment of Inertia Ic

Ic represents a moment of inertia of a club about the center of gravity of the club. The unit of the moment of inertia Ic is ($g \cdot cm^2$). The moment of inertia Ic can be measured by using, for example, MODEL NUMBER RK/005-002 manufactured by INERTIA DYNAMICS.

When the golf club 2 has a greater moment of inertia Ic about its center of gravity, the behavior of the golf club 2 is stabilized and a swaying motion of the golf club 2 is suppressed. As a result, variation in hitting points is lessened. From this viewpoint, the moment of inertia Ic is preferably greater than or equal to $550\times10^3$ ($g \cdot cm^2$), more preferably greater than or equal to $570\times10^3$ ($g \cdot cm^2$), and further preferably greater than or equal to $590\times10^3$ ($g \cdot cm^2$). Considering the swing moment of inertia Isw, the moment of inertia Ic is preferably less than or equal to $680\times10^3$ ($g \cdot cm^2$), more preferably less than or equal to $670\times10^3$ ($g \cdot cm^2$), and further preferably less than or equal to $660\times10^3$ ($g \cdot cm^2$).

In the present embodiment, the moment of inertia Ic is increased by concentrating weight in the head 4 and the butt end region R1.

2-8. Isw/Ic

"Isw/Ic" is a ratio of the swing moment of inertia Isw to the moment of inertia Ic. A decrease in this ratio increases the moment of inertia Ic relatively to the swing moment of inertia Isw, whereby the golf club 2 is unlikely to have a swaying motion while still maintaining the ease-of-swing. As a result, variation in hitting points is suppressed. From this viewpoint, Isw/Ic is preferably less than or equal to 9.50, more preferably less than or equal to 9.40, further preferably less than or equal to 9.30, and still further preferably less than or equal to 9.20. Considering the preferable ranges of Ic and Isw, Isw/Ic is preferably greater than or equal to 7.50, more preferably greater than or equal to 7.80, and further preferably greater than or equal to 8.00.

2-9. Shaft Weight Ws

Reduction of the shaft weight Ws makes it possible to effectively concentrate weight in the butt end region R1 while suppressing the swing moment of inertia Isw. From this viewpoint, the shaft weight Ws is preferably less than or equal to 48 g, and more preferably less than or equal to 47 g. From the viewpoint of the strength of the shaft, the shaft weight Ws is preferably greater than or equal to 25 g, more preferably greater than or equal to 30 g, and further preferably greater than or equal to 35 g.

2-10. Grip Weight Wg

An increase in the grip weight Wg increases the club weight Wc and the moment of inertia Ic, whereby the weight W1 of the but end region R1 can be increased. From this viewpoint, the grip weight Wg is preferably greater than or equal to 42 g, more preferably greater than or equal to 43 g, and further preferably greater than or equal to 44 g. With a view to preventing the club weight Wc from becoming excessively great, the grip weight Wg is preferably less than or equal to 52 g, more preferably less than or equal to 50 g, and further preferably less than or equal to 48 g.

2-11. Golf Club Number

The longer clubs are, the greater the difference in flight distance performance between the clubs is. Furthermore, the longer a club is, the more significantly the hitting point thereof varies in each shot, resulting in that the direction of a hit ball is hardly stabilized. From this viewpoint, a wood-type club is preferable, and a driver is particularly preferable. The driver has a real loft angle of, usually, greater than or equal to 7° and less than or equal to 15°. The head has a volume of preferably greater than or equal to 350 cc, more preferably greater than or equal to 380 cc, further preferably greater than or equal to 400 cc, and still further preferably greater than or equal to 420 cc. From the viewpoint of the head strength, the head preferably has a volume of less than or equal to 470 cc.

3. Measuring Method

Methods for measuring the specifications are as follows.

3-1. Club Length Lc

The club length Lc in the present application is measured in accordance with the regulation announced by the R&A (the Royal and Ancient Golf Club of Saint Andrews). This regulation is described in "1c. Length" in "1. Clubs" of "Appendix II-13 Design of Clubs" in the latest Rules of Golf issued by R&A. The measurement method is performed when the club is placed on a horizontal plane and the sole thereof is set against a plane having an angle of 60 degrees with respect to the horizontal plane. This method is therefore also referred to as the "60-degree measurement method".

3-2. Moment of Inertia Ic

As described above, the moment of inertia Ic is the moment of inertia of the golf club 2 about the center of gravity of the golf club 2. The moment of inertia Ic is the moment of inertia of the golf club 2 about an axis line that passes through the center of gravity of the golf club 2 and is perpendicular to the shaft center line Z1. As shown in the above formula (1), the moment of inertia Ic is used in calculation of the swing moment of inertia Isw.

Figure 7:
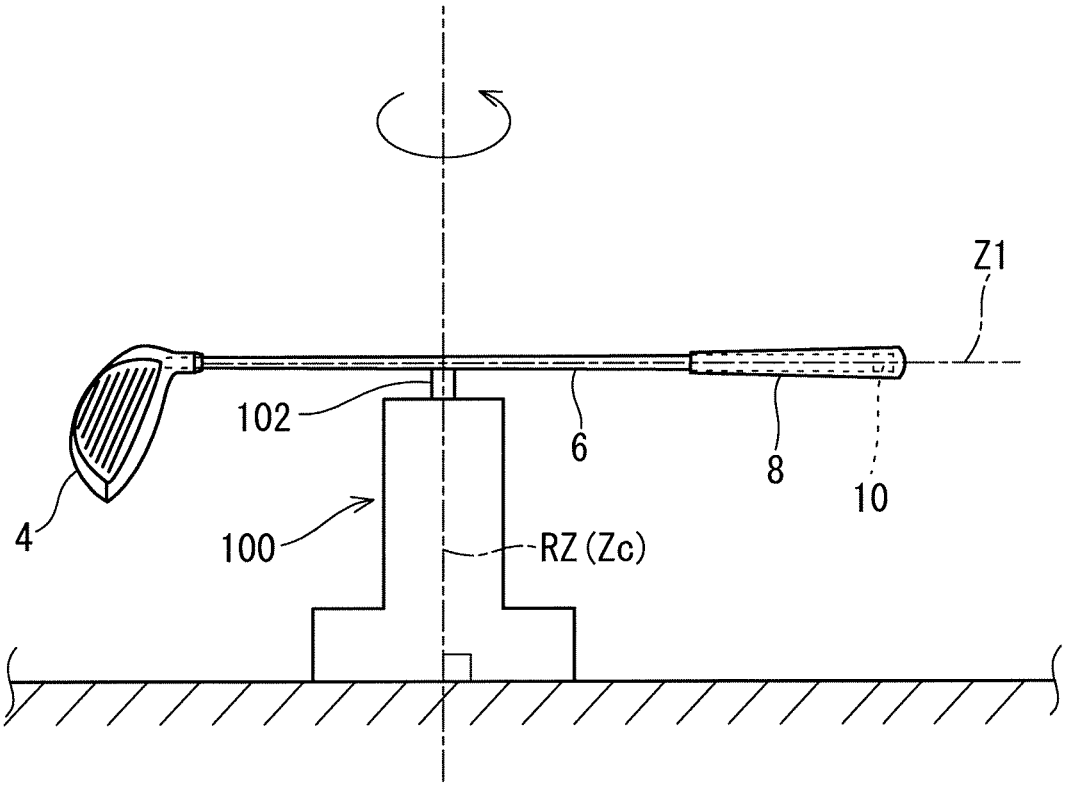
FIG. 7 is a schematic diagram illustrating a method for measuring a moment of inertia of a golf club.

FIG. 7 shows a method for measuring the moment of inertia Ic. As shown in FIG. 7, the golf club 2 is placed on a measuring jig 102 of a moment-of-inertia measuring instrument 100 such that the shaft center line Z1 is set in the horizontal direction. As the moment-of-inertia measuring instrument 100, MODEL NUMBER RK/005-002 manufactured by INERTIA DYNAMICS is used. The golf club 2 is placed on the measuring jig 102 so that the center of gravity of the golf club 2 is positioned on a rotation axis RZ. The rotation axis RZ coincides with the axis Zc. Thus, the moment of inertia Ic is measured.

EXAMPLES

Hereinafter, effects of the present disclosure are clarified by examples, but the present disclosure should not be exclusively interpreted based on the descriptions of the examples.

Sample 1

A forged face member, and a casted body member, were welded, whereby a driver head made of a titanium alloy was obtained. A shaft 6 was obtained by the sheet winding method using a plurality of prepreg sheets. A rubber composition was heated and pressurized in a mold, whereby a grip was obtained. In the forming of the grip, a foam rubber and a non-foam rubber were used. A part of a grip body portion 8*a* of the grip was made of a foam rubber. The foam rubber was used in an inner layer of the grip body portion 8*a*. An outer layer of the grip body portion 8*a* was made of a non-foam rubber. An end cap portion 8*b* of the grip was made of a non-foam rubber. A formed weight body 20 was covered with a rubber material, and this was set in a mold, pressurized, and heated, whereby a weight member 10 having a cover member 30 made of a vulcanized rubber was obtained. This weight member 10 was attached to a butt portion of the shaft 6, and thereafter, the grip was attached to the shaft 6, whereby a golf club as shown in FIGS. 1 and 2 was obtained.

Other Samples

Other samples were obtained in the same manner as that of Sample 1, except for the specifications shown in Table 1 below.

Respective specifications and evaluation results of the samples are shown in Table 1 below. Methods for measuring the specifications are as explained above.

TABLE 1

Specifications and Evaluation Results of Samples

| | Unit | Sample 1 | Sample 2 | Sample 3 | Sample 4 | Sample 5 | Sample 6 | Sample 7 | Sample 8 | Sample 9 | Sample 10 | Sample 11 |
|---|---|---|---|---|---|---|---|---|---|---|---|---|
| Club length Lc | inch | 45.50 | 45.50 | 45.50 | 45.50 | 45.50 | 45.50 | 45.50 | 45.50 | 45.50 | 44.50 | 46.00 |
| Head weight Wh | g | 196 | 196 | 190 | 196 | 196 | 196 | 202 | 190 | 196 | 196 | 196 |
| Shaft weight Ws | g | 47 | 47 | 47 | 47 | 47 | 53 | 47 | 59 | 47 | 47 | 47 |
| Grip weight Wg | g | 44 | 44 | 44 | 30 | 50 | 44 | 44 | 44 | 44 | 44 | 44 |
| Weight of weight member | g | 6 | 0 | 6 | 0 | 0 | 0 | 0 | 0 | 10 | 6 | 6 |
| Weight W1 of butt end region R1 | g | 38.2 | 32.2 | 38.2 | 24.6 | 36.6 | 33.8 | 32.2 | 34.7 | 42.2 | 38.2 | 38.2 |
| Club weight Wc | g | 296 | 290 | 290 | 276 | 296 | 296 | 296 | 296 | 300 | 296 | 296 |
| Grip-end weight proportion | % | 12.9 | 11.1 | 13.2 | 8.9 | 12.4 | 11.4 | 10.9 | 11.7 | 14.1 | 12.9 | 12.9 |
| Moment of inertia Ic of club | $\times 10^3$ g · cm$^2$ | 588 | 542 | 583 | 446 | 580 | 548 | 546 | 549 | 618 | 560 | 602 |
| Swing moment of inertia Isw | $\times 10^3$ g · cm$^2$ | 5449 | 5436 | 5303 | 5403 | 5451 | 5494 | 5582 | 5406 | 5456 | 5246 | 5552 |
| ISW/IC | — | 9.27 | 10.03 | 9.10 | 12.10 | 9.39 | 10.02 | 10.22 | 9.84 | 8.83 | 9.36 | 9.23 |
| Flight distance | yard | 225 | 220 | 221 | 220 | 223 | 218 | 218 | 219 | 224 | 218 | 219 |
| Directional stability of | yard | 10 | 14 | 14 | 22 | 10 | 11 | 11 | 10 | 8 | 6 | 13 |

TABLE 1-continued

| Specifications and Evaluation Results of Samples | | | | | | | | | | | | |
|---|---|---|---|---|---|---|---|---|---|---|---|---|
| | Unit | Sample 1 | Sample 2 | Sample 3 | Sample 4 | Sample 5 | Sample 6 | Sample 7 | Sample 8 | Sample 9 | Sample 10 | Sample 11 |
| hit balls Variation in hitting points | — | 13.5 | 16.9 | 16.5 | 21.1 | 13.6 | 14.5 | 14.6 | 13.3 | 11.2 | 13.6 | 15.1 |

Evaluation Method

Evaluations were carried out in the following way.

Tester

Ten golfers who were classified in the above-described Category X carried out tests.

Flight Distance

"Flight distance" is a distance traveled by a hit ball up to a point where the hit ball reaches finally, which includes run. Each of the above-described ten testers shot five golf balls with each club. As to each sample, the average value of all pieces of flight distance data is shown in Table above.

Directional Stability of Hit Balls

Each of the above-described ten testers shot five golf balls with each club. A distance of deviation rightward or leftward from the target direction was measured. The distance of deviation is regarded as a plus value, irrespective of whether the deviation was rightward or leftward. As to each sample, the average value of the deviation distances is shown in Table above.

Variation in Hitting Points

Hitting points were measured by ball-hitting tests. The hitting points were measured using a shot marker (impact marker). The shot marker was attached to the face surface of each head, and the positions of hitting marks on the face surface were measured. Each of the above-described ten testers shot five golf balls with each club, and the distance (off-center distance) of each hitting point from the face center was measured. The standard deviations of the off-center distances are shown in Table above.

As these evaluation results indicate, the superiority of the present disclosure is obvious.

The following clauses are disclosed regarding the above-described embodiments.

Clause 1

A golf club including:

a head;

a shaft; and a grip, wherein the head has a weight Wh of greater than or equal to 195 g, the golf club has a club length Lc of greater than or equal to 45.0 inches, the golf club has a club weight Wc of greater than or equal to 295 g, and the golf club has a swing moment of inertia Isw of less than or equal to $5470\times10^3$ ($g\cdot cm^2$), the swing moment of inertia Isw ($g\cdot cm^2$) being calculated by the following formula (1):

$$Isw=Wc\times(Lg+40)^2+Ic \quad (1),$$

where Wc represents the club weight (g), Lg represents a distance (cm) in an axial direction between a butt end of the grip and a center of gravity of the golf club, and Ic represents a moment of inertia ($g\cdot cm^2$) of the golf club about the center of gravity of the golf club.

Clause 2

The golf club according to clause 1, wherein a region having a distance from a butt end of the golf club of less than or equal to 100 mm has a weight W1 that accounts for 10.0% or more of the club weight Wc.

Clause 3

The golf club according to clause 1 or 2, wherein the moment of inertia Ic of the golf club about the center of gravity of the golf club is greater than or equal to $550\times10^3$ ($g\cdot cm^2$).

Clause 4

The golf club according to clause 3, wherein a ratio Isw/Ic of the swing moment of inertia Isw to the moment of inertia Ic is less than or equal to 9.50.

The foregoing description describes only examples, and various changes can be made without departing from the essence of the present disclosure.

What is claimed is:

1. A golf club comprising:

a head;

a shaft; and a grip, wherein the head has a weight Wh of greater than or equal to 195 g, the golf club has a club length Lc of greater than or equal to 45.0 inches, the golf club has a club weight Wc of greater than or equal to 295 g, the golf club has a swing moment of inertia Isw of less than or equal to $5470\times10^3$ ($g\cdot cm^2$), the swing moment of inertia Isw ($g\cdot cm^2$) being calculated by the following formula (1):

$$Isw=Wc\times(Lg+40)^2+Ic \quad (1),$$

where Wc represents the club weight (g), Lg represents a distance (cm) in an axial direction between a butt end of the grip and a center of gravity of the golf club, and Ic represents a moment of inertia ($g\cdot cm^2$) of the golf club about the center of gravity of the golf club, and a region having a distance from a butt end of the golf club of less than or equal to 100 mm has a weight W1 that accounts for 10.0% or more of the club weight Wc.

2. The golf club according to claim 1, wherein the weight W1 accounts for 12.0% or more of the club weight Wc.

3. The golf club according to claim 1, wherein the moment of inertia Ic of the golf club about the center of gravity of the golf club is greater than or equal to $550\times10^3$ (g·cm).

4. The golf club according to claim 3, wherein a ratio Isw/Ic of the swing moment of inertia Isw to the moment of inertia Ic is less than or equal to 9.50.

5. The golf club according to claim 4, wherein the ratio Isw/Ic is less than or equal to 9.30.

6. The golf club according to claim 5, wherein the shaft has a weight of less than or equal to 48 g.

7. The golf club according to claim 6, wherein the grip has a weight of greater than or equal to 42 g.

8. The golf club according to claim 3, wherein the club length Lc is less than or equal to 46 inches.

* * * * *